US006601632B2

(12) United States Patent
Bouveresse et al.

(10) Patent No.: US 6,601,632 B2
(45) Date of Patent: Aug. 5, 2003

(54) MANUAL DEVICE FOR TRANSFERRING A FILM FROM A BACKING STRIP TO A SUBSTRATE

(75) Inventors: Jeanne-Antide Bouveresse, Rueil Malmaison (FR); Winfried Huthmacher, Frankfurt (DE); Hans-Peter Melahn, Neumunster (DE); Scott Poore, Simpsonville, SC (US); Georg Semmler, Wiesbaden (DE)

(73) Assignee: BIC Deutschland GmbH & Co., Liederbach (DE)

( * ) Notice: Subject to any disclaimer, the term of this patent is extended or adjusted under 35 U.S.C. 154(b) by 0 days.

(21) Appl. No.: 10/061,344

(22) Filed: Feb. 4, 2002

(65) Prior Publication Data

US 2002/0088554 A1 Jul. 11, 2002

Related U.S. Application Data

(63) Continuation of application No. PCT/EP00/06873, filed on Jul. 18, 2000.

(30) Foreign Application Priority Data

Aug. 3, 1999 (DE) ..... 199 36 445

(51) Int. Cl.[7] ..... B32B 31/00

(52) U.S. Cl. ..... 156/577; 156/523; 156/579; 118/76; 242/160.4; 242/171; 242/588.6; 206/411

(58) Field of Search ..... 156/523, 527, 156/538, 540, 574, 577, 579; 118/76, 200, 257; 225/46; 242/160.2, 160.4, 170, 171, 588, 588.2, 588.3, 588.6

(56) References Cited

U.S. PATENT DOCUMENTS

| | | | | |
|---|---|---|---|---|
| 4,851,076 A | | 7/1989 | Manusch et al. | 156/577 |
| 5,049,229 A | | 9/1991 | Czech | 156/577 |
| 5,150,851 A | | 9/1992 | Manusch et al. | 242/68.1 |
| 5,379,477 A | | 1/1995 | Tamai et al. | 15/104.94 |
| 5,490,898 A | * | 2/1996 | Koyama | 118/200 |
| 5,556,469 A | | 9/1996 | Koyama et al. | 118/257 |
| 5,770,007 A | | 6/1998 | Czech et al. | 156/540 |
| 6,125,903 A | * | 10/2000 | Uchida | 118/257 |
| 6,394,165 B1 | * | 5/2002 | Rader | 156/540 |

FOREIGN PATENT DOCUMENTS

DE 39 11 402 A1 10/1990

* cited by examiner

*Primary Examiner*—Mark A. Osele
(74) *Attorney, Agent, or Firm*—Pennie & Edmonds LLP

(57) ABSTRACT

The invention relates to a manual device for transferring a film consisting for example of adhesive, covering or coloured material from a backing strip to a substrate, with a housing in which a supply reel and a take-up reel for the backing strip are mounted so that they can rotate via a pivot bearing, which is formed by two coaxially arranged bearing components, engaging in each other like sleeves in the region of an annular or hollow cylindrical bearing joint, of which one bearing component is held on the housing so that it cannot rotate and the other bearing component is a part of the relevant reel support and in the course of which a return stop is provided for both reels with a locking pawl which meshes with a gear ring. To guarantee a compact design and economical fabrication, the locking pawl is arranged on the one bearing component against a spring force so that it yields elastically and the gear ring is arranged on the other bearing component.

34 Claims, 3 Drawing Sheets

MANUAL DEVICE FOR TRANSFERRING A FILM FROM A BACKING STRIP TO A SUBSTRATE

CROSS-REFERENCE TO RELATED APPLICATIONS

The present application is a continuation of the U.S. National Stage designation of co-pending International Patent Application PCT/EP00/06873, filed on Jul. 18, 2000, which claims priority to German Patent Application 199 36 445.1, filed Aug. 3, 1999. The entire content of both these applications is expressly incorporated herein by reference thereto.

FIELD OF THE INVENTION

The invention refers to a manual device for the transfer of film from a tape applicator and more particularly the present invention relates to a return stop for preventing undesired back rotation of a reel.

BACKGROUND OF THE INVENTION

In a manual device for transferring a film from a backing strip to a substrate (alternately referenced herein as a tape applicator for the sake of convenience), the backing strip carrying the film is supplied on a supply reel, drawn over an applicator tip, at which the backing strip is pressed against the substrate to apply the film, and taken up on a take-up reel. When in an operating mode, the film is withdrawn from the supply reel by a manually generated movement, by means of which the manual device is moved along the substrate, the film being released from the backing strip and the backing strip simultaneously being wound off of the supply reel and onto the take-up reel. To guarantee this mode of operation, the speed at which the material is wound onto the take-up reel must be at least as great as the speed at which it is unwound from the supply reel as otherwise loops would form during recoiling, which could lead to the manual device being unable to function. A drive connection is provided between the supply reel and the take-up reel for the purpose of this specific function which drives the take-up reel in a transmission ratio such that the take-up speed is greater than the unwinding speed of the supply reel. It must be remembered here that the effective outer diameters of the supply reel and the take-up reel are constantly changing as the backing strip is unwound from the supply reel and wound onto the take-up reel. This problem is solved firstly by the drive connection driving the take-up reel so quickly that firstly the winding speed effective there is always the same or greater than the unwinding speed and namely even when the outer diameter of the take-up reel is at its maximum and the outer diameter of the supply reel is at its minimum, and secondly by the drive connection functioning with slip such that although the take-up reel is driven with a constantly effective torque so that the section of backing strip being wound on is under tension, at the same time the slip is effective within the drive connection so that the section of backing strip being wound onto the take-up reel does not tear.

A further problem with the mode of operation of an existing manual device consists of the fact that both the supply reel and the take-up reel each tend to run backwards somewhat after a rotary movement caused by removing the backing strip, which can be caused by stresses in the backing strip. The reels reversing in this way can also cause small loops which can impair the function of the manual device.

A manual device of the type described above, has been described, for example, in patents EP 0 267 396 B2 (corresponding to U.S. Pat. No. 4,851,076 to Manusch et al.), EP 0 680 914 D1 (corresponding to U.S. Pat. No. 5,577,007 to Czech et al.), EP 0 656 308 D1 (corresponding to U.S. Pat. No. 5,556,469 to Koyama et al.), and DE 39 00 156 C2 (corresponding to U.S. Pat. No. 5,049,229 to Czech). In one existing manual device, the supply reel and the take-up reel can be mounted so that they can rotate around axes of rotation which are arranged at a distance from each other, or they can also be mounted so that they can rotate around a common axis of rotation, as described in DE 39 00 156 C2 (corresponding to U.S. Pat. No. 5,049,229).

In the manual device described in EP 0 267 396 B2 (corresponding to U.S. Pat. No. 4,851,076), the drive connection between the supply reel and the take-up reel is formed by a gear wheel drive with an intermediate gear wheel, the return stop meshing with the intermediate gear wheel and being formed by at least one sprung tongue, which is fixed to the housing and meshing with the teeth of the intermediate gear wheel with its sprung free end, the said end extending as a secant. This known design not only contains a large number of elements, but also requires a relatively large space for installation because both the intermediate gear wheel and the sprung tongue must be housed in an unobstructed region inside the housing.

In the manual device described in EP 0 680 914 (corresponding to U.S. Pat. No. 5,770,007), in which the drive connection between the supply reel and the take-up reel takes the form of a friction wheel drive, a return stop for the take-up device is formed by a toothed surface on the radial face surface of a bearing bush of the recoiling reel (see FIG. 3), the toothed surface meshing with opposing gearing on an opposite surface fixed to the housing. In this known design, the take-up reel must execute small axial movements when rotating through the return stop while operating, the said movements being disadvantageous for both the friction wheel drive and for taking up the backing strip, an additional spring element also being required which strikes the take-up reel with its toothed surface against the opposing gearing.

A design similar to the design described above is provided in a manual device according to EP 0 656 308 (corresponding to U.S. Pat. No. 5,556,469). In this known design, the drive connection between the supply reel and the take-up reel is also formed by a friction wheel drive, the return stop meshing with the take-up reel and being formed by a locking pawl arranged in a cut-out of a friction wheel arranged on the take-up reel, which has a pawl on its free end and is pretensioned elastically with this against a toothed surface, which is formed on an additional toothed ring, and is fixed to the housing on an internal surface of the housing. This known design also needs an additional component, namely the toothed ring, whereby it is also to be expected despite the elastic flexibility of the locking pawl, that if the return stop is turned too far, the take-up reel will make axial movements or will at least be pushed in the direction of axial movements. Therefore, increased wear is to be expected because only a relatively small annular surface on the body of the reel is available as the mounting for the take-up reel.

A manual device is described in DE 39 00 156 C2 (corresponding U.S. Pat. No. 5,049,229), in which the supply reel and the take-up reel are arranged side by side in a coaxial arrangement, the drive connection being arranged between the reel walls, which are adjacent to each other, and being formed by a coupling tooth, which is arranged on a sprung arm which projects radially from the one reel wall and therefore can be moved radially and is struck radially outwards against a gear ring on the other reel wall using elastic pretensioning of the sprung arm. The teeth of the gear ring and the coupling tooth have angled tooth flanks so that the coupling tooth is forced out of the gaps between the teeth when a certain tensile stress is exceeded in the take-up section of the backing strip and the above-mentioned slip takes place in the drive connection. This known design therefore involves a slip clutch in the drive connection between the reels, both components being rotating components. This friction clutch cannot fulfill the function of a return stop. Therefore a return stop is provided which meshes with the supply reel, which is formed by an engaging finger, which meshes with a gear ring on the supply reel in the form of a locking pawl. This design of a return stop is also expensive and has large dimensions and an interior space of a considerable size having to be present for the engaging finger to enable it to be arranged so that it can function. This also leads to a large format for the manual device as a whole.

SUMMARY OF THE INVENTION

The present invention provides a compact device for transferring a film from a backing strip to a substrate, or "tape applicator," that is economical to manufacture. In accordance with the principles of the present invention, first and second bearing components are provided in coaxial engagement in the device. The first and second bearing components rotate relative to each other and a return stop is provided therebetween to prevent undesired backward rotation. The present invention is compact, as it permits a return stop to be arranged within the axial projection region of the bearing components, thus causing it to have scarcely any negative effect on the interior of the housing.

Moreover, in accordance with the principles of the present invention the return stop may be formed with a locking pawl arranged on one bearing component so that it yields elastically against a spring force, and a gear ring arranged on the other bearing component. Thus, the present invention also permits the locking pawl to operate reliably between the bearing components, the associated reel (associated with the bearing component on which the locking pawl is provided) not participating in the movements of the locking pawl, thus enabling the locking pawl to remain in position axially while in its operating position. Moreover, the present invention can be manufactured simply, little material being required because the locking pawl according to the invention can be produced in a compact format while guaranteeing reliable operation.

It is advantageous for the locking pawl to be arranged so that it is movable radially or yields radially. In this case, unused spaces which are radially adjacent with respect to the locking pawl can be utilized, into which the locking pawl can move, e.g., the unused space inside the housing or an unused space inside the inner bearing component, especially if the latter is formed by a hollow, cylindrical journal to save material and weight.

If the locking pawl is arranged on the free end of a pawl arm, it does not require an additional spring element to knock the locking pawl into its operating position, because the intrinsic elasticity of the pawl arm can be used as the spring force. Thus it is possible within the scope of the invention for the pawl arm to extend parallel to the axis of rotation of the relevant reel or to run curved in an arch shape around the axis of rotation. The latter configuration particularly permits a narrow format because the length of the pawl arm is normally to be greater than its width.

The device according to the principle of the present invention also permits a compact format in the axial direction in this case because the locking pawl can be arranged in the region in which the bearing components overlap, therefore within the bearing region. Here the locking pawl can be arranged in the region of a cut-out in the bearing component concerned. A space is created in this way in which the locking pawl can move.

Moreover, it is advantageous for the gear ring of the locking pawl to be arranged countersunk in the bearing component concerned, while the locking pawl is arranged in such a way that, in its operating position, it projects beyond the bearing joint, which is present between the bearing components and is particularly of a hollow cylindrical design and engages in the gaps between the teeth of the gear ring. In a design of this type, putting the bearing components together axially is not impaired during assembly of the manual device because the locking pawl can move out of the way radially when the components are being pushed together axially and therefore the locking pawl is not in the way of the relevant edges of the other bearing component. Furthermore, it is advantageous for two locking pawls to be arranged opposite each other, as a result of which the locking effect can be increased if the locking pawls are of a slightly yielding design. It is an advantage here to offset one locking pawl in such a way in the circumferential direction that when the one locking pawl is in a gap between the teeth, the other locking pawl is on a tooth of the gear ring. As a result, even if the tooth angles are relatively flat, which is desirable for reasons of ease of movement, small locking sections achieve a reverse movement of the reel concerned, which counters the formation of loops effectively.

The devices formed in accordance with the principles of the present invention can be formed on the existing components as single components so that no additional components are necessary. A manufacturing process involving injection-molding is particularly suitable, especially if the relevant components of the manual device are made of plastic. Thus the locking pawl acts between the bearing components in all the designs according to the invention, namely in a region of the cavity of the housing in which the locking pawl does not disrupt the cavity and is therefore also unable to disrupt the cycle for the backing strip.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
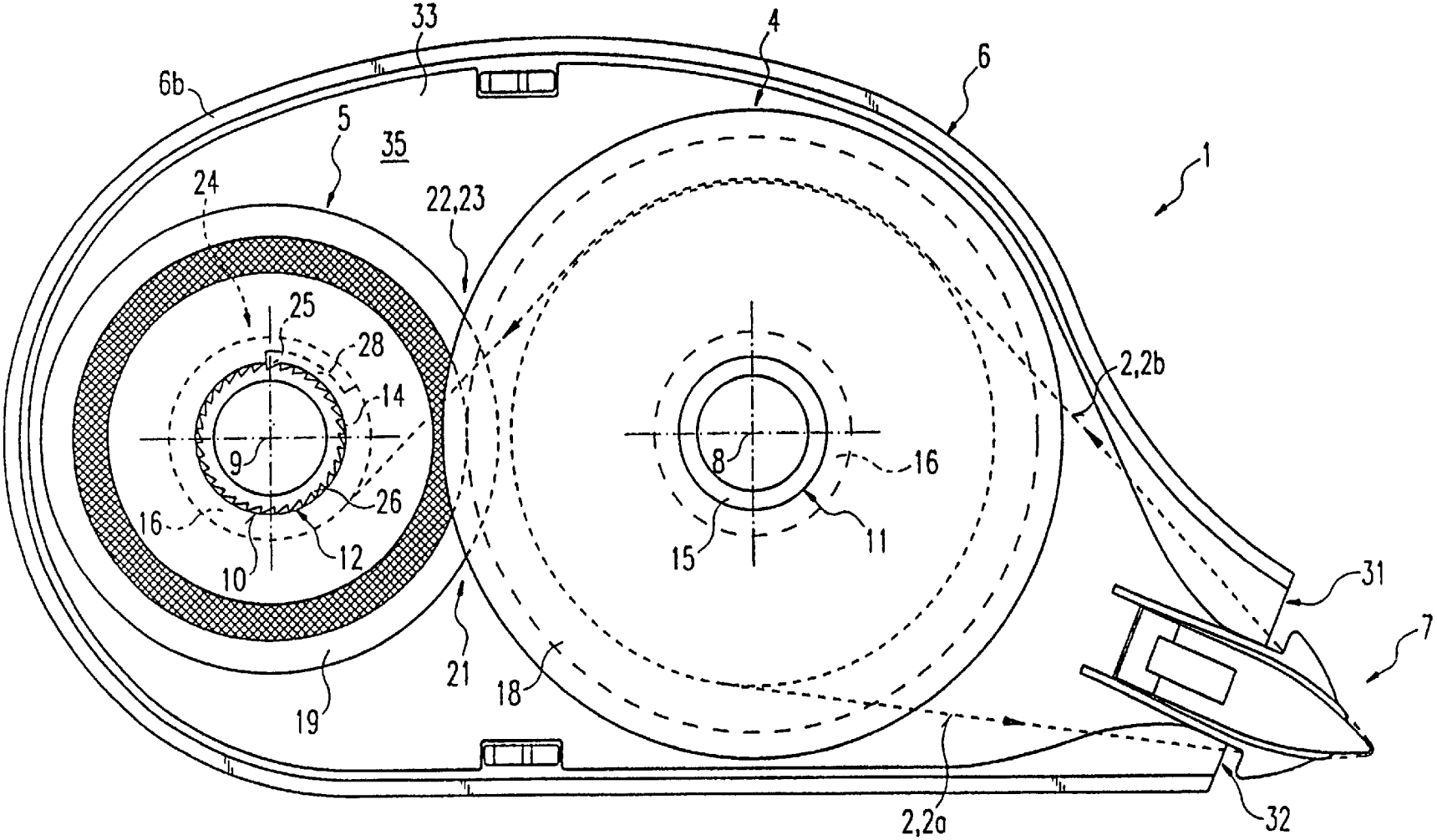
FIG. 1 is a side elevated view of a manual device, formed in accordance with the principles of the present invention with the housing open.

Embodiments of the invention are described below by referring to the drawings. Exemplary tape applicators formed in accordance with the principles of the present invention are illustrated in FIG. 1 through FIG. 5, in which same reference numbers refer to identical constituent components or elements.

Device 1 for transferring a film from a backing strip to a substrate, as shown in FIG. 1, serves to transfer a film arranged on a backing strip 2 to a substrate, backing strip 2 being arranged on supply reel 4 and take-up reel 5 in housing 6 of manual device 1. An application component or applicator tip 7 is provided, projecting from housing 6, around which backing strip 2 runs. Backing strip section 2*a* can be pulled off supply reel 4 by pressing application component 7 on the substrate while simultaneously displacing manual device 1, backing strip 2 then being wound automatically on to take-up reel 5 as backing strip section 2*b*.

In the present exemplary embodiment, supply reel 4 and take-up reel 5 are mounted so that they can rotate around two respective axes of rotation 8, 9, situated a distance apart from each other, at the strip contact level E of backing strip 2. The associated pivot bearings 11, 12 for reels 4, 5 are each formed by a journal 13, 14 (see FIG. 4), preferably a hollow cylinder, mounted on housing 6, directly or indirectly, so that it can rotate, the associated reel 4, 5 being mounted with a bearing bush 15, 16, preferably in the form of a hollow cylinder, so that the reel can rotate on the journal. The axial positioning of reels 4, 5 can be determined by the relevant opposing walls of housing 6. The annular or hollow cylindrical bearing joint between the components of the bearing is designated 10.

Figure 4:
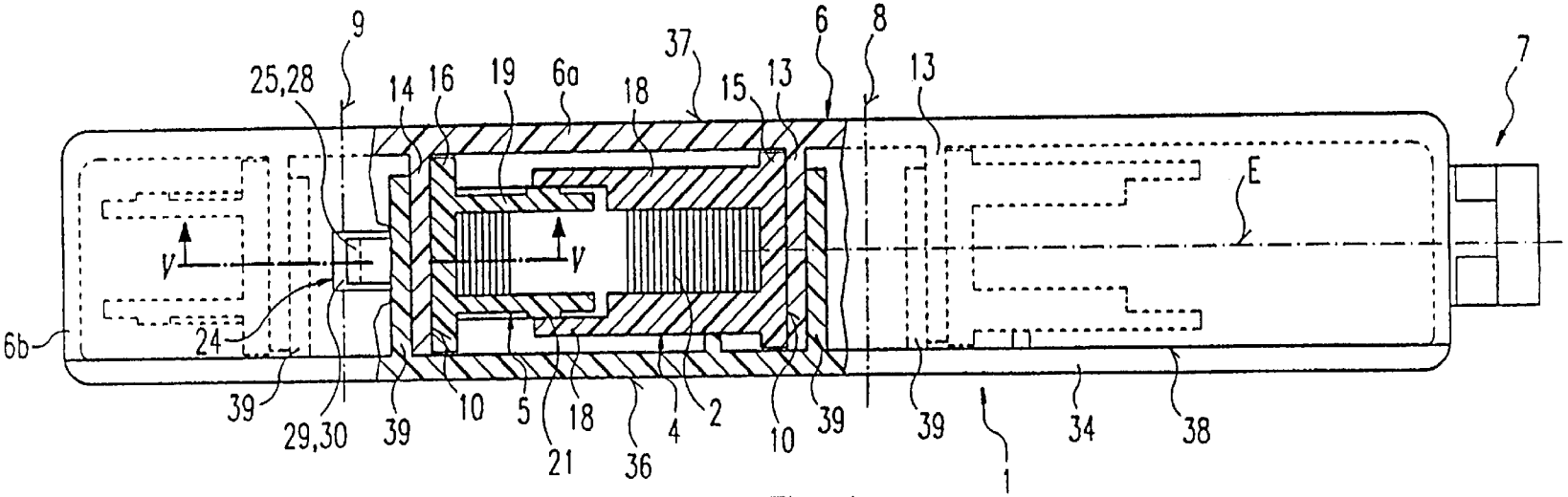
FIG. 4 is a top view of the manual device with the housing closed but partially cut away, whereby one take-up reel is present in a somewhat different design.

As shown in FIG. 4, reels 4, 5 each have a cylindrical winding element, on which backing strip 2 is or will be wound and which can be formed by the bearing bush 15, 16 respectively. In addition, reels 4, 5 each have a disc-shaped reel wall 18, 19 on one or both sides, the radial dimensions of which are greater than the distance between the axes of the axes of rotation 8, 9 so that respective reel walls 18, 19, arranged on one side, overlap each other. In the present exemplary embodiment, reels 4, 5 have reel walls 18, 19 on both sides, supply reel 4 with its reel walls 18 overlapping reel wall 19 of take-up reel 5 in a region with radial (see FIG. 4) or cone-shaped (see FIG. 2) friction surfaces 21 or annular friction surfaces, which may be arranged inside and/or on the outside.

A drive connection 22 with an integrated friction clutch 23 is arranged between supply reel 4 and take-up reel 5. Drive connection 22 is designed in such a way that take-up reel 5 can be driven so fast, taking account of the respective effective coil diameter (full or empty reel 4, 5), that backing strip section 2*b* to be wound thereon is always slightly under tension. During this process, friction clutch 23 prevents backing strip 2 from tearing. Consequently, friction clutch 23 comes into operation above a certain drive torque, effective in drive connection 22, 50 that although take-up reel 5 is driven faster, take-up reel 5 only turns with a speed at the winding on surface which corresponds to the speed of movement of backing strip 2. The drive and slip effect described above is guaranteed by the friction-rotation lock between at least one pair of reel walls 18, 19 which permits a corresponding torque transmission. Depending on the coil size of reels 4, 5, it is necessary for drive connection 22 to include gearing to drive take-up reel 5 faster. In the present exemplary embodiment, this is achieved by the diameter used for reel wall 18 of supply reel 4 being of a larger size in the friction contact zone than the corresponding diameter of reel wall 19 of take-up reel 5. It is possible, within the scope of the invention, to achieve the friction effect between reel walls 18, 19 by means of an axial compressive stress, such that reel walls 18, 19 are in contact with each other, it being possible to generate the compressive stress via the intrinsic elasticity of one or both reel walls 18, 19. In this case, reels 4, 5 with their reel walls 18, 19 can be prefabricated so that they are under- and/or oversized, causing reel walls 18, 19 to be in contact with each other when fitted in such a way that the required lateral stress is present.

It is also possible, within the scope of the invention, for the friction effect to be produced by raised and recessed areas in the form of teeth with the relevant gaps between the teeth (not shown), such that reel walls 18, 19 are not required to be in contact with each other using axial stress but rather being displaced elastically in the axial direction when the teeth are subject to excess pressure.

Figure 2:
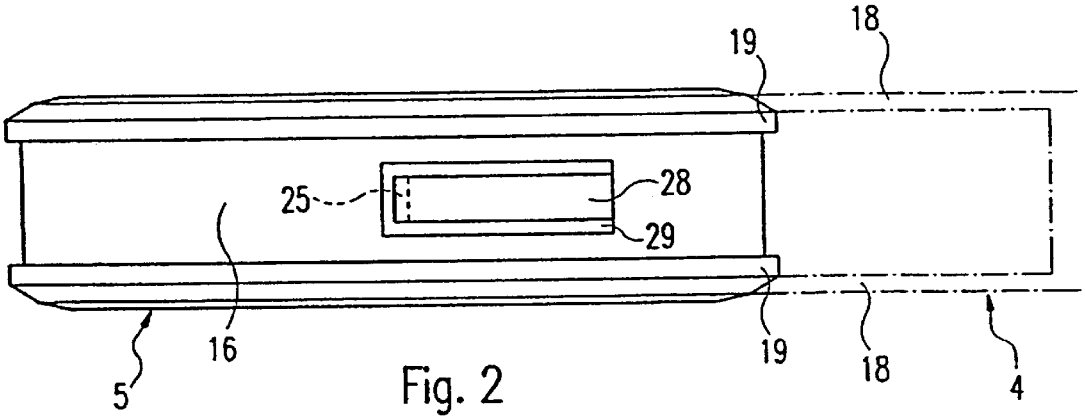
FIG. 2 is a reel according to the invention in a view transverse to its axis of rotation.
Figure 3:
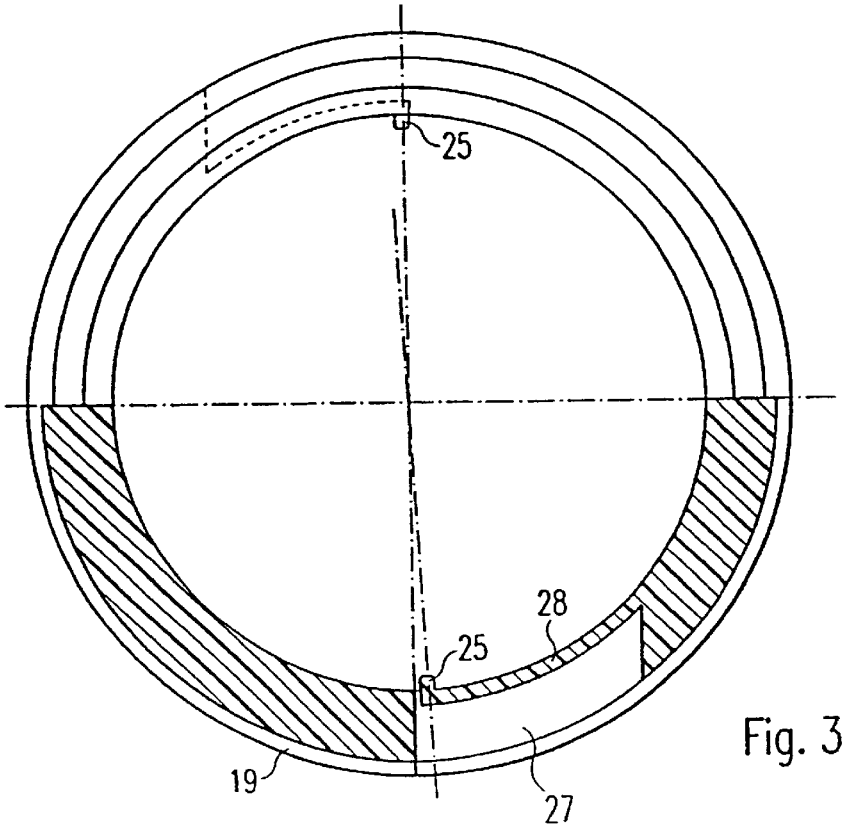
FIG. 3 is an axial view of the reel according to FIG. 2, partly shown in a cross-section.
Figure 5:
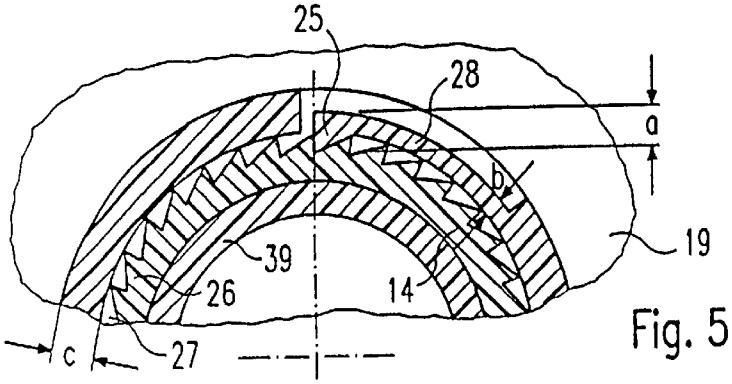
FIG. 5 is an enlarged view of the part section, along the lines V—V in FIG. 4.

To prevent reels 4, 5 from turning backwards, for example because of stresses in backing strip 2, a return stop 24 (see FIG. 4) is allocated to one of the two reels 4, 5 between the first and second bearing components. As shown in the exemplary embodiments illustrated in FIGS. 4 and 5, return stop 24 is provided in the region of the respective journal and bearing bush components 13 to 16, which belong together. In the present exemplary embodiment, return stop 24 is arranged between journal 14 and bearing bush 16 of take-up reel 5. Return stop 24 is formed by a locking pawl drive with an elastically yielding locking pawl 25 (See FIG. 5) and a gear ring 26 meshing with it, whereby locking pawl 25 can be arranged on an associated journal or bearing bush and gear ring 26 can be arranged on the respective other component. In the present exemplary embodiment, locking pawl 25 is arranged on bearing bush 16 and gear ring 26 is arranged on journal 14. As shown in FIG. 5 in particular, gear ring 26 is arranged in the axial projection region of the, e.g., hollow cylindrical journal 14. This is achieved by gear ring 26 being arranged in the region of an annular groove 27, the teeth projecting within annular groove 27 from their base surface so that the teeth do not project beyond the bearing surface of the component on which it is mounted (i.e., journal 14 in the embodiment of FIG. 4) and therefore the rotary mounting is not impaired. As shown in FIGS. 2 and 3, locking pawl 25 is arranged on the free end of a pawl arm 28 extending in the circumferential direction which is situated in the region of an unused space or cut-out 29 in bearing bush 16, pawl arm 28 being connected to bearing bush 16 on the end which is turned away from locking pawl 25. The free end of pawl arm 28 can be bent out in a radially elastic manner with locking pawl 25. Then, as shown in FIG. 5, locking pawl 25 projects beyond the inner sheath surface of bearing bush 16, for example in the neutral position of pawl arm 28, which is relieved of stress, or in its engaging position and it projects into the gaps between the teeth of gear ring 26. The flanks of the teeth of gear ring 26 and/or the flanks of locking pawl 25 present a flank angle such that when take-up reel 5 turns in the take-up direction of rotation above a desirable level of tensile stress in backing strip 2, the locking pawl drive slips, locking pawl 25 being pushed out of gear ring 26, preferably emitting a sequence of click sounds, and when turned in the opposite direction, locking pawl 25 exercises its locking function. In the present embodiment of the invention, the teeth of gear ring 26 and preferably also of locking pawl 25 have a saw-toothed cross-section, the flank of locking pawl 25 turned in the recoiling direction of rotation is inclined and the other flank is steep. To prevent locking pawl 25 and relevant pawl arm section 28 from impairing the outer sheath surface of bearing bush 16, which forms the winding surface, when rebounding radially, by projecting through, the relevant radial dimension "a" of locking pawl 25 must be of a size such that when it is in the position in which it is pushed out of gear ring 26, it does not project beyond the outer sheath surface of bearing bush 16. The radial dimension of locking pawl 25 can correspond approximately to the radial dimension of bearing bush 16. The spring movement can be achieved by the thickness "b" of pawl arm 28 being designed to be thinner than locking pawl 25 by approximately the depth of penetration of locking pawl 25 and also thinner than the thickness "C" of bearing bush 16 50 that a space 30 is present for locking pawl 25 and for pawl arm 28 into which they can move, in this case on the outside in bearing bush 16.

Within the scope of the invention, (see FIG. 5) locking pawl 25 can be formed on journal 14 and gear ring 26 on bearing bush 16 in a corresponding manner, operation in the radially opposite direction being produced in this way. The impeding or locking function of return stop 24 is sufficient to prevent accidental turning of the associated reel.

As shown in FIG. 5, it is advantageous to arrange locking pawl 25 and pawl arm 28 in such a way that locking pawl 25 is struck against the teeth or the base of the gap between the teeth of gear ring 26 because of the intrinsic elasticity of pawl arm 28. In a design of this type locking pawl 25 generates a so-called locking pawl noise (clicking noise), which is desirable, each time it strikes the tooth flanks or the base of the tooth.

As shown in FIG. 3, two locking pawls are preferably arranged diametrically opposite to each other. Then one locking pawl 25 can be offset in such a way in the circumferential direction that one locking pawl is opposite to a tooth while the other is in a gap between the teeth.

As shown in FIG. 1, the relevant housing wall holds wedge-shaped application component 7 in a hole, slots 31, 32 being arranged in the housing wall between the lower side and the upper side of application component 7 and the housing wall through which backing strip 2 extends. Housing 6 has a housing aperture 33, which can be revealed or closed by a cover 34 so that reels 4, 5 can be exchanged.

In the present exemplary embodiment, journals 13, 14 are permanently attached to the housing, as illustrated in FIG. 4. However, it is possible within the scope of the invention for journals 13, 14 to be permanently connected to a component, which forms a replaceable cassette with reels 4, 5, which is positioned in its operating position in the inside 35 of housing 6 by positioning elements so that the cassette, which is not shown, and/or journals 13, 14 are arranged so that they cannot be turned or so that they are fixed in the housing.

As shown in FIG. 1, in the present embodiment of the invention, housing 6 has the shape of a flat box, the wide sides 36, 37 of which extend transverse to the axes of rotation 8, 9 so that housing 6 is arranged on edge in its normal operating position. Application component 7 is situated in the front lower corner region of manual device 1 or housing 6. In the present embodiment of the invention, cover 34 is arranged on the wide side so that the dividing joint 38 between cover 34 and the remaining housing component extends parallel to the strip contact level E of backing strip 2. The housing wall opposite cover 34 is designated 6*a*. The circumferential wall is designated 6*b*.

The individual components of manual device 1 are made of plastic and are preferably injection-molded components which can be manufactured quickly and economically, even if the shape is difficult. Locking pawl 25 and locking pawl arm 28 on the one hand and gear ring 26 on the other are formed on the associated journal and the associated bearing bush as a single component so that return stop 24 does not generate any additional components but rather they are manufactured as one component with the components which support them. In addition, return stop 24 with its components is situated in the material regions of journal 14 of bearing bush 16.

Therefore, the unobstructed inner space 35 is not reduced. Journals 13, 14 are also molded on here as a single component on the broad side of the housing wall 6*a* or on the above-mentioned cassette component. As shown in FIG. 4, hollow cylindrical pins 39, for example, can be molded on to the inside of the other housing wall as connection elements for the cover 34 and which engage in hollow cylindrical journals 13, 14 with a gentle clamping action.

The present invention may be embodied in other specific forms without departing from the essential characteristics thereof. It is, for example, also possible to have the tape mounted on a different element that does not have the pawl arm attached thereto. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A device for transferring a film from a backing strip to a substrate, said device comprising:

a housing;

a first non-rotatable bearing component non-rotatably mounted on said housing;

a first cylindrical bearing component rotatably mounted over said first non-rotatable bearing component for rotation about a first rotation axis;

a second non-rotatable bearing component non-rotatably mounted on said housing;

a second cylindrical bearing component rotatably mounted over said second non-rotatable bearing component for rotation about a second rotation axis;

a supply reel on which a backing strip with film carried thereon is supplied; and a take-up reel for taking up the backing strip after the film is transferred therefrom to a substrate;

wherein:

said first non-rotatable bearing component and said first cylindrical bearing component form a pivot bearing for said supply reel;

said second non-rotatable bearing component and said second cylindrical bearing component form a pivot bearing for said take-up reel;

a dividing joint is defined between said bearing components of said at least one of said pivot bearings;

a return stop is provided on at least one of said pivot bearings for said supply reel and said pivot bearing for said take-up reel;

said return stop comprises a locking pawl meshing with a gear ring;

said locking pawl is arranged on one of said bearing components of said at least one of said pivot bearings against a spring force so that said locking pawl yields elastically;

said locking pawl projects beyond said dividing joint;

said gear ring is arranged countersunk in an annular groove on the other bearing component of said at least one of said pivot bearings;

said gear ring is co-axially arranged with respect to a cylindrical bearing surface of said one of said bearing components; and said locking pawl is co-axially arranged with respect to a cylindrical bearing surface of said other bearing component.

2. A device for transferring a film from a backing strip to a substrate, said device comprising:

a housing;

a first non-rotatable bearing component non-rotatably mounted on said housing;

a first cylindrical bearing component rotatably mounted over said first non-rotatable bearing component for rotation about a first rotation axis;

a second non-rotatable bearing component non-rotatably mounted on said housing;

a second cylindrical bearing component rotatably mounted over said second non-rotatable bearing component for rotation about a second rotation axis;

a supply reel on which a backing strip with film carried thereon is supplied; and a take-up reel for taking up the backing strip after the film is transferred therefrom to a substrate;

wherein:

said first non-rotatable bearing component and said first cylindrical bearing component form a pivot bearing for said supply reel;

said second non-rotatable bearing component and said second cylindrical bearing component form a pivot bearing for said take-up reel;

a return stop is provided on at least one of said pivot bearing for said supply reel and said pivot bearing for said take-up reel;

said return stop comprises a locking pawl meshing with a gear ring;

said locking pawl is arranged on one of said bearing components of said at least one of said pivot bearings against a spring force so that said locking pawl yields elastically; and said gear ring is arranged in an annular groove in the other bearing component of said at least one of said pivot bearings.

3. A device as in claim 2, wherein said locking pawl is radially movable against said spring force.

4. A device as in claim 2, wherein said locking pawl is arranged on said cylindrical bearing component of said at least one of said pivot bearings and said gear ring is arranged on said non-rotatable bearing component.

5. A device as in claim 2, wherein said locking pawl is arranged on one end of a pawl arm having a first end radially bendable relative to the rotation axis of said at least one of said pivot bearings and a second end connected to said one of said bearing components.

6. A device as in claim 5, wherein:

said bearing component on which said pawl arm is provided rotates about an axis of rotation; and said pawl arm is curved in an arc shape around said axis of rotation.

7. A device as in claim 2, wherein said locking pawl is arranged on said cylindrical bearing component of said at least one of said pivot bearings.

8. A device as in claim 2, wherein said locking pawl is provided on a pawl arm arranged in a cut-out of said at least one of said pivot bearings.

9. A device as in claim 2, wherein said second cylindrical bearing component forms a cylindrical winding element on which a backing strip may be wound thereabout.

10. A device as in claim 2, wherein a free space is defined on said one of said bearing components on a side of said locking pawl opposite said gear ring.

11. A device as in claim 2, wherein two locking pawls are arranged opposite each other.

12. A device as in claim 2, wherein:

said locking pawl is formed as a single component with said one of said bearing components; and said gear ring is formed as a single component on said other of said bearing components.

13. A device as in claim 12, wherein at least one of said locking pawl and said gear ring has a saw-toothed shape.

14. A device as in claim 2, wherein at least one of said non-rotatable bearing components is formed as a single component with said housing.

15. A device as in claim 2, wherein:

said first cylindrical bearing component is a part of said supply reel; and said second cylindrical bearing component is a part of said take-up reel.

16. A device as in claim 2, wherein:

said locking pawl is provided on a pawl arm;

said gear ring comprises a plurality of teeth; and said pawl arm elastically biases said locking pawl into engagement with said teeth of said gear ring while allowing said pawl arm to yield elastically during rotation of said second bearing component.

17. A device as in claim 2, wherein:

rotation of said second bearing component causes said locking pawl to ride along teeth of said gear ring and to move in said stop plane;

whereby action of said return stop does not cause axial movement of said second bearing component with respect to said first bearing component.

18. A device as in claim 2, wherein:

said gear ring comprises a plurality of circumferentially extending teeth;

said locking pawl is formed on a pawl arm;

a space is defined in said one of said first and second bearing components on which said locking pawl is provided; and said locking pawl arm moves into said space upon riding over said teeth.

19. A device as in claim 2, wherein said second cylindrical bearing component is configured such that a backing strip may be wound thereabout.

20. A device for transferring a film from a backing strip to a substrate, said device comprising:

a housing;

a first non-rotatable bearing component non-rotatably mounted on said housing;

a first cylindrical bearing component rotatably mounted over said first non-rotatable bearing component for rotation about a first rotation axis;

a second non-rotatable bearing component non-rotatably mounted on said housing;

a second cylindrical bearing component rotatably mounted over said second non-rotatable bearing component for rotation about a second rotation axis;

a supply reel on which a backing strip with film carried thereon is supplied; and a take-up reel for taking up the backing strip after the film is transferred therefrom to a substrate;

wherein:

said first non-rotatable bearing component and said first cylindrical bearing component form a pivot bearing for said supply reel;

said second non-rotatable bearing component and said second cylindrical bearing component form a pivot bearing for said take-up reel;

a return stop is provided on at least one of said pivot bearings for said supply reel and said pivot bearing for said take-up reel;

said return stop comprises two locking pawls meshing with a gear ring;

said two locking pawls are arranged on one of said bearing components of at least one of said pivot bearings against a spring force so that said two locking pawls yield elastically;

said gear ring is arranged on the other bearing component of said at least one of said pivot bearings;

teeth are provided around said gear ring; and said two locking pawls are arranged offset from each other in a circumferential direction around said one of said bearing components such that when one locking pawl is situated in a gap between said teeth of said gear ring said other locking pawl is opposite a tooth of said gear ring.

21. A device as in claim 20, wherein:

a dividing joint is defined between said bearing components of said at least one of said pivot bearings;

said locking pawls projects beyond said dividing joint; and said gear ring is arranged countersunk in said other bearing component.

22. A device as in claim 20, wherein said locking pawls are radially movable against said spring force.

23. A device as in claim 20, wherein said locking pawls are arranged on said cylindrical bearing component of said at least one of said pivot bearings and said gear ring is arranged on said non-rotatable bearing component.

24. A device as in claim 20, wherein said locking pawls are arranged on one end of respective pawl arms having a first end radially bendable relative to the rotation axis of said at least one of said pivot bearings and a second end connected to said one of said bearing components.

25. A device as in claim 24, wherein:

said bearing component on which said respective pawl arms are provided about an axis of rotation; and said pawl arm is curved in an arc shape around said axis of rotation.

26. A device as in claim 20, wherein said locking pawls are arranged on said cylindrical bearing component of said at least one of said pivot bearings.

27. A device as in claim 20, wherein said locking pawls are provided on respective pawl arms arranged in a cut-out of said at least one of said pivot bearings.

28. A device as in claim 20, wherein at least one of said non-rotatable bearing components is formed as a single component with said housing.

29. A device as in claim 20, wherein:

said first cylindrical bearing component is a part of said supply reel; and said second cylindrical bearing component is a part of said take-up reel.

30. A device as in claim 20, wherein:

said locking pawls are provided on respective pawl arms;

said gear ring comprises a plurality of teeth; and said pawl arms elastically bias said locking pawls into engagement with said teeth or gear ring while allowing said pawl arms to yield elastically during rotation of said bearing component.

31. A device as in claim 20, wherein:

said gear ring comprises a plurality of circumferentially extending teeth;

said locking pawls are formed on respective pawl arms;

a space is defined in said one of said first and second bearing components on said locking pawls are provided; and said pawl arms move into said space upon riding over said teeth.

32. A device as in claim 20, wherein said second cylindrical bearing component is configured such that a backing strip may be wound therabout.

33. A device as in claim 20, wherein said cylindrical bearing component forms a cylindrical winding element on which a backing strip may be wound.

34. A device for transferring a film from a backing strip to a substrate, said device comprising:

a housing;

a first non-rotatable bearing component non-rotatably mounted on said housing;

a first cylindrical bearing component rotatably mounted over said first non-rotatable bearing component for rotation about a first rotation axis;

a second non-rotatable bearing component non-rotatably mounted on said housing;

a second cylindrical bearing component rotatably mounted over said second non-rotatable bearing component for rotation about a second rotation axis;

a supply reel on which a backing strip with film carried thereon is supplied; and a take-up reel for taking up the backing strip after the film is transferred therefrom to a substrate;

wherein:

said first non-rotatable bearing component and said first cylindrical bearing component form a pivot bearing for said supply reel;

said second non-rotatable bearing component and said second cylindrical bearing component form a pivot bearing for said take-up reel;

a return stop is provided on at least one of said pivot bearings for said supply reel and said pivot bearing for said take-up reel;

said return stop comprises two locking pawls arranged opposite each other and meshing with a gear ring provided with teeth;

said locking pawl is arranged on one of said bearing components of said at least one of said pivot bearings against a spring force so that said locking pawl yields elastically;

said two locking pawls are arranged offset from each other in a circumferential direction around said one of said bearing components such that when one locking pawl is situated in a gap between said teeth of said gear ring said other locking pawl is opposite a tooth of said gear ring;

said gear ring is arranged countersunk in an annual groove on the other bearing component of said at least one of said pivot bearings;

said gear ring is co-axially arranged with respect to a cylindrical bearing surface of said one of said bearing components; and said locking pawl is co-axially arranged with respect to a cylindrical bearing surface of said other bearing component.

* * * * *